United States Patent [19]

Belbel et al.

[11] Patent Number: 4,513,270

[45] Date of Patent: Apr. 23, 1985

[54] CONTACTOR HAVING SELF-PROTECTION MEANS AGAINST THE EFFECT OF THE FORCES OF REPULSION BETWEEN THE CONTACTS

[75] Inventors: Elie Belbel, Epinay sur Seine; Christian Blanchard, Nanterre; Michel Lauraire, Courbevoie; Louis Fechant, Le Vesinet; André Haury, Le Raincy, all of France

[73] Assignee: La Telemecanique Electrique, France

[21] Appl. No.: 445,774

[22] Filed: Nov. 30, 1982

[30] Foreign Application Priority Data

Nov. 30, 1981 [FR] France ..... 81 22975

[51] Int. Cl.[3] ..... H01H 77/08

[52] U.S. Cl. ..... 335/195; 335/16

[58] Field of Search ..... 335/16, 194, 195

[56] References Cited

U.S. PATENT DOCUMENTS 2,679,561 5/1954 Thompson ..... 335/195

2,841,670 7/1958 Peter ..... 335/195

3,263,042 7/1966 Dyer et al. ..... 335/16

3,887,888 6/1975 Bayles et al. ..... 335/16

*Primary Examiner*—E. A. Goldberg

*Assistant Examiner*—George Andrews

*Attorney, Agent, or Firm*—William A. Drucker

[57] ABSTRACT

A contactor capable of having a very high breaking power comprises a movable contact carrier bridge (3) having a central part in the form of a blade (3*c*) and conducting J-shaped pieces (2*a*–2*b*) supporting fixed contacts. A non-magnetic blade bent in the form of a U is mounted slidable inside a hollow movable insulating contact holder (1) and guides and holds at its upper end a magnetic plate (8) cooperating with said blade (3*c*) and forming an air-gap with another U-shaped magnetic piece (6), disposed between the legs of the bent blade (5) and integral (at 7) with the contact holder (1). A contact pressure spring (4) bears on the basis of the U-shaped magnetic piece (6) and on the bottom of the bent blade (5).

5 Claims, 14 Drawing Figures

CONTACTOR HAVING SELF-PROTECTION MEANS AGAINST THE EFFECT OF THE FORCES OF REPULSION BETWEEN THE CONTACTS

BACKGROUND OF THE INVENTION

The invention relations to the protection of contactors against the effects of contact separation due to the repulsion forces between the contact carriers.

A contactor is normally designed to withstand currents having RMS values in the order of 12 In (or 6 In according to the contactor size). In being the rate current. Beyond this value, there is a risk of welding and, at least, of the contacts wearing, caused by different effects which will be analyzed hereafter.

THE PRIOR ART

It is known to associate with a contactor a circuit-breaking device or a device for limiting and interrupting the current flowing in the main contact of the contactor, which device comes into play solely should a short-circuit or high overload occur and causes limitation and rapid interruption of the said current, before the contactor has in theory the time to be damaged.

The overload may occur, either when the contactor is closed, or during closure thereof. If it corresponds to currents which, in the absence of rapid protection means, might for example exceed 100 In, the action of the switch member is very rapid, that is to say that the current flowing in the main contact of the contactor reaches a peak value of for example 40 to 50 In, then drops to the value 0, in a time, the order of 2 ms for example, very much less than the duration of a half-wave of the power mains.

Now, there exist forces of repulsion between the contacts. These forces exist, in particular, in contactors comprising fixed contact carrier conductors bent in the form of a J, following the passage of currents in opposite directions in one of the two legs of the J and in the movable contact bridge. Even in contactors having fixed rectilinear contact carrier conductors, since the contact between fixed and movable contact insets takes place through a "spot" of very small diameter through which the current lines pass, these latter are bent, causing a repulsion force varying inversely with the diameter of the contact spot and proportional to the square of the current.

In short, these repulsion forces, as soon as the current reaches a sufficient strength, overcome the action of the spring of the contactor providing the contact pressure, so that the contacts will separate.

When, for very high overloads as stated above, the current very rapidly reaches 20 or 30 In, the result is a high repulsion force sufficient for the movable contact to be moved away a relatively large distance from the fixed contact. Considering the inertia of the device, the movable contact then falls back only well after the breaking of the current and the risks of welding are very much reduced. This alternating separation and reclosing of the contacts for each overload causes however abnormal wear.

On the other hand, if the overload corresponds to currents the RMS value of which reaches for example only 15 In, the interrupting device exerts no appreciable action for limiting the current during a half-wave and, consequently, a current greater than 12 In may flow through the contact. The repulsion forces then appear in the neighbourhood of the peak of the current and, since they are much smaller than in the preceding case, when they cease the contact closes again on comparatively high current. The result is an appreciable risk of welding. In short, in the association of a contactor with a device for breaking and limiting overload current, such as a limiting circuit breaker and even a conventional circuit-breaker (for overloads not exceeding 50 to 60 In) and a fuse there exists a range of intensities of the overload current in which a risk of welding of the contacts of the contactor is added to the other risks of destroying the apparatus and to the inevitable wear of the contacts. It will be noted that, when the overload occurs on closure of the contact, after a period of time during which there appears mechanical bouncing of the contacts themselves capable of causing welding, after which period of time the contacts are stabilized, one comes back to the above-described case where the overload occurs when the contactor is in the closed condition.

OBJECT OF THE INVENTION

It is an object of the invention to provide means for compensating, during the period of time between appearance of an overload and the opening of the contactor circuit, the effect of the electrodynamic repulsion forces which arise between the fixed and movable contacts of the contactor, so as to prevent the contacts from separating inopportunely with the consequences which would result therefrom (wear, risk of welding) for certain values of the overload current.

SUMMARY OF THE INVENTION

In accordance with the invention, this compensation is obtained by means of a piece made from a soft magnetic material rigidly secured to a contact holder permanently interlocked with the movable part of the contactor electromagnet and so arranged that, as soon as the overload current reaches the one which standards require of a traditional contactor, namely six to fifteen times the rated current in the conducting movable contact carrier, it exerts an attraction force on a portion of said movable contact carrier and/or a second piece made from a soft magnetic material rigidly coupled with said movable contact carrier or bearing directly on said movable contact carrier and subjected to the action of a contact pressure spring, said force of attraction being sufficient to counter balance the effect of the repulsion forces which are exerted between the fixed and movable contacts.

It should of course be understood that, during normal operation of the contactor at its rated current, the compensation device does not substantially contribute to modifying the contact pressure, which it only effectively reinforces when an overload develops appreciable repulsion forces. The contact pressure is therefore provided, in a conventional way, by a pressure spring associated with the movable contact carrier of the contactor.

As will be explained hereafter, this compensation of the effect of the repulsion forces results in an appreciable increase in the closing power and the breaking power of the contactor.

According to a first embodiment, which will be preferred for heavy load contactors having fixed contact supports bent in the form of a J for improving blowing out of the arcs appearing during normal operation, said first magnetic piece has the shape of a U whose base is rigidly secured to a contact holder integral with the movable part of the electromagnet, whereas the second magnetic piece is adapted to form a variable air-gap with the upper ends of the legs of the U and said part of the conducting movable contact carrier has the shape of a blade on which said second magnetic piece bears and which is engaged in the opening of the U forming a narrow gap.

According to a second embodiment, the magnetic piece coupled indirectly to the movable part of the electromagnet has the shape of a U and said part of the conducting movable contact carrier has the shape of a blade which is engaged in the opening of the U while forming a narrow air gap.

According to a third embodiment, said second magnetic piece is maintained, by said contact pressure spring which is associated with the conducting movable contact carrier, in abutment against said part of said contact carrier and forms a variable air gap with said first magnetic piece.

BRIEF DESCRIPTION OF THE DRAWINGS

Other features, as well as advantages of the invention, will be clear from the following description.

In the appended drawings.

DESCRIPTION OF THE PREFERRED EMBODIMENT

Figure 1:
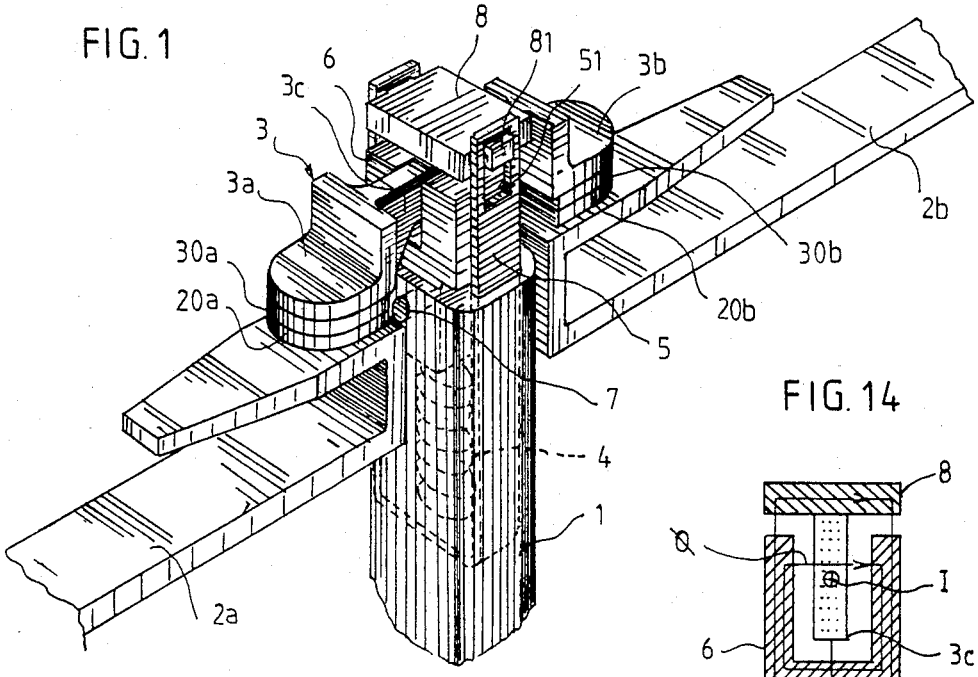
FIG. 1 is a perspective view of the contact assembly of a double break contact bridge contactor, equipped with a magnetic compensation device in accordance with the first embodiment of the invention.

In FIGS. 1 to 5, there is shown a contact holder comprising an insulating part or contact holder 1 integral with the armature of an electromagnet, not shown, and two fixed contacts 20*a*–20*b*, carried by conductors 2*a*–2*b* bent in the form of a "J" and cooperating with a movable contact bridge 3 with two legs 3*a*–3*b* carrying respectively contact insets 30*a*–30*b*, on each side of a vertical blade 3*c*.

A contact pressure spring 4 is housed in a strip of non-magnetic material bent in a U shape, whose lower part is disposed so as to be able to slide inside piece 1, and whose upper part, which projects from piece 1, is provided in the vicinity of its ends with two windows 50–51.

A U-shaped piece made from a soft magnetic material 6 is disposed between the legs of blade 5, in their upper part, and fixed at its base to piece 1 by means of a pin 7.

Figure 2:
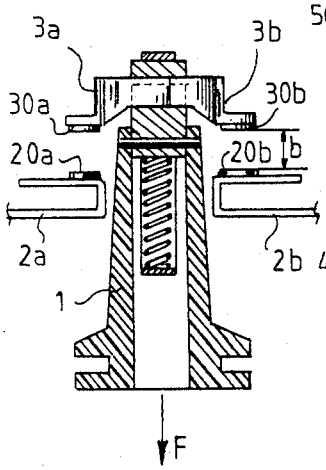
FIGS. 2 and 3 show the same assembly, respectively seen in a front and end view, in the open position.
Figure 3:
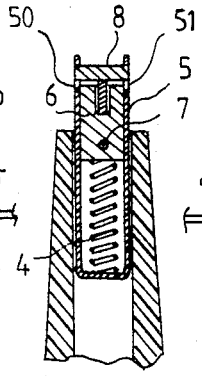
Figure 4:
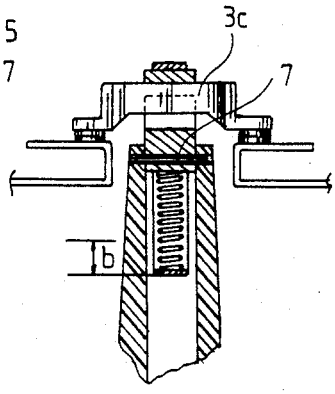
FIGS. 4 and 5 show the same assembly, respectively in a front and end view in the closed position.
Figure 5:
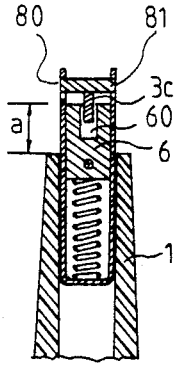
Figure 6:
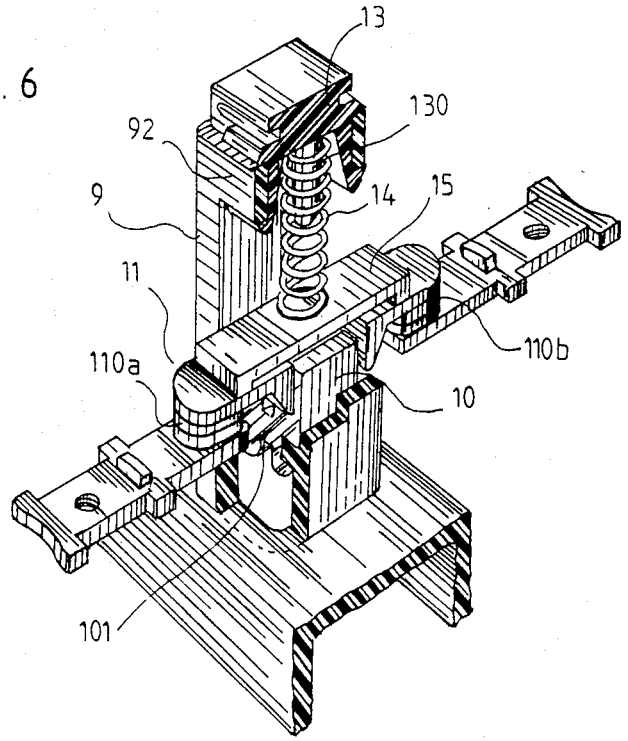
FIG. 6 is a perspective view of the contact assembly of a double break contact bridge contactor, equipped with a magnetic compensation device in accordance with the second embodiment of the invention.
Figure 7:
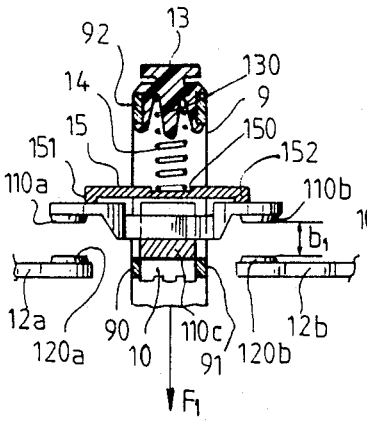
FIGS. 7 and 8 show the same assembly, respectively in a front and end view, in the open position.

The central vertical blade 3*c* which connects together the two legs 3*a*–3*b* of bridge 3 engages in the median groove 60 provided in the upper face of piece 6 and, as shown in FIGS. 2 and 3, when the contacts are open, blade 3*c*, bearing with its edge on the bottom of groove 60, has its upper part slightly projected from the groove, so that a second parallelepipedic piece 8, made from a soft magnetic material, engaged by the projections 80–81, provided on its edges, in windows 50–51 and against the lower face of which bears blade 3*c*, leaves a small gap between said lower face and upper face of piece 6.

Spring 4 bears at one end against the lower face of piece 6 and at its other end against the base of piece 5.

When, with the armature attracted, piece 1 is driven downwards (arrow F, FIG. 2), piece 6 firmly interlocked with piece 1 by pin 7, moves the same distance a. Spring 4, bearing against the bottom strip 5, drives this latter downwards over a smaller distance b, which corresponds to the distance between the insets 20*a* and 30*a* on the one hand and 20*b* and 30*b* on the other. In fact, strip 5 drives piece 8 and the bridge 3 until the contacts close. At that moment, strip 5 can no longer move and, with piece 6 continuing to descend, spring 4 is compressed thus providing a certain contact pressure sufficient for rated operation.

Figure 14:
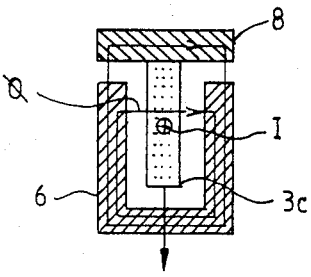
FIG. 14 shows in section a schematic view of the magnetic pieces and of the movable contact support; for the first embodiment.

When a current flows in the bridge (see FIG. 14), this current induces a magnetic field in pieces 6 and 8 so that a magnetic force of attraction is exerted between piece 6 and piece 8. The current which flows in the central blade 3*c* cooperates with a leak flux $\Phi$ which is situated between the legs of piece 6 which communicates to this blade forces directed towards the bottom of groove 60.

The arrangement and dimensioning is such that, for current strengths of the order of the rated value In, the vectorial sum of the attraction forces, and of the reverse electro-dynamic forces developed in the J-shaped conductors, is practically negligible and the contact pressure is provided solely by the spring.

On the other hand, should an overload appear from a peak current of 12 to 15 In for example, the force of attraction related to the presence of magnetic pieces 6 and 8 becomes appreciable and reinforces the effect of the pressure of the spring. Beyond 50 or 60 In, this force of attraction reaches a limit value, the magnetic pieces 6 and 8 being saturated, but the complementary forces due to the cooperation of the flux $\Phi 1$ and of this current continue to increase.

Tests have shown that a contactor formed with the device shown has an exceptionally large cut-off or breaking power and closing power, of the order of 40 to 50 In, that is to say several times greater than that which would be obtained with the contact spring alone.

Thus, the cut-off or closure power may reach, in the embodiment described which is particularly well-suited to the construction of high load contactors, effective values of 10 KA to 15 KA instead of 4 KA for an apparatus with a rated load of 300 Amps. Thus, such a contactor may be used without associating it with a limitating circuit-breaker or with a fuse when it is certain, from the properties of the installation which it supplies, that no short-circuit will ever exceed these values. However, current monitoring means (for example magneto-thermal) will have to be associated with this installation to control rapid opening of the contactor which will guarantee that this installation is not damaged.

It will be noted that in practice it could not be a question of using a spring alone providing the contact pressure which would correspond to such breaking or closing power, for the electro-magnet would have to be capable, during closing, of succeeding in compressing a spring of such strength, which is not economically feasible. In the device described, the electro-magnet will only have to compress a normal spring and it is only when the current, once established, reaches a peak value corresponding to an appreciable overload that the accessory compensation device will exert a complementary pressure on the contacts.

Of course, piece 6 will exert, for closure on a peak current corresponding to an overload, a reaction on the armature in the form of a pulling force tending to wrench the armature away from the electro-magnet. It is consequently important to take precautions to prevent the armature from breaking away from the fixed yoke of the electromagnet. To this end, it is advantageous to supply the electromagnet with rectified current during the holding phase: since the force of attraction in this case never passes through the zero value, the risk of wrenching the armature away is reduced. This precaution may be combined or not with relatively large dimensioning of the electromagnet. A judicious calculation of the characteristics of the U shaped piece and of the electromagnet is necessary so that this latter possesses, at the time of a contact closure causing application of industrial currents of the order of 12 In, a kinetic energy sufficient to overcome the abovementioned forces of attraction and the force of the different springs.

When the overload of about 12 In occurs before the contactor is closed, at the moment of pulling-in, e.g. when the pulling-in force of the armature of the electromagnet is far from having reached its maximum value, it is important that the said pulling-in force, added to the complementary attraction force exerted by pieces 6 and 8 be sufficient to counter the electro-dynamic repulsion forces. To this end, it is advantageous to use an electromagnet having a small gap, or a very strong pulling-in current, as is the case in particular in contactors commercialized by the applicant under the name of "serie F". In these contactors, the pulling-in force is generated from a-c and, owing to a suitable electronic circuit arrangement, the holding force is generated through rectified a-c with a small undulation and a reduced amplitude which is accurately controlled.

The surprising result mentioned (increase of the closure and breaking power) is due to the fact that the additional holding force overcomes the harmful effect of repulsion phenomena between the contacts, which phenomena become normally sufficient, when the peak current reaches 12 to 15 In, so that, with the contacts moving slightly away from each other, there is formation of an arc. A high risk of welding of the contacts or even of explosion of the box may result from the absence of these additional holding forces.

The additional holding force further results in reducing the mechanical bouncing phenomena of the contacts which appear during closure, so in reducing the wear and this from about 8 In.

In the embodiment illustrated in FIGS. 6 to 10, to the insulating piece 9 integral with the armature (not shown) of the electro-magnet is fixed a piece 10 made from a soft magnetic material, having at its base a double hooking tongue 101 which engages between two suitably profiled projections 90–91 on the internal wall of piece 9.

Figure 8:
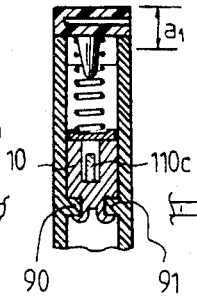
Figure 9:
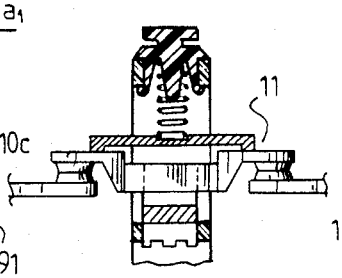
FIGS. 9 and 10 show the same assembly respectively in a front and end view, in the closed position.
Figure 10:
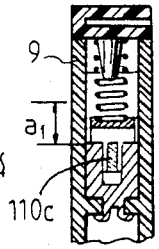

Piece 10 has a U shaped cross-section and the double-break movable contact bridge 11, which carries the two contact insets **110*a*–110*b*, comprises a central blade 110*c* which engages in the U, as shown in FIG. 8. The fixed contacts 120*a* and 120*b* are here carried by rectilinear blades 12*a*, 12*b***.

Piece 9 is provided, at its upper end, with an arch 92 to which is fixed, by coupling together complementary profiled parts, an insulating material piece 13 having a central stud 130 by means of which one end of a pressure spring 14 is guided. The other end of the spring cooperates with a recess 150 provided in a insulating piece 15 which bears, by its ends 151–152, on the two respective legs of the movable contact bridge 11.

When, with the movable armature of the electromagnet attracted, piece 9 is driven downwards (arrow $F_1$ FIG. 7), pieces 10 and 13 undergo the same movement $a_1$ and spring 14 moves piece 15, so the contact bridge 11, by the distance $b_1 < a_1$ which causes the movable contacts to be applied to the fixed contacts. With piece 9 continuing its downward movement over a distance $a_1$–$b_1$, when blade **110*c* is immobilized, this latter ceases to be in contact with the bottom of the U (FIGS. 9 and 10) and spring 14** is compressed so as to provide the contact pressure.

When a current flows in the bridge, it induces a magnetic field in piece 10, so that an electro-magnetic force is exerted on blade **110*c***, in the direction increasing the pressure forces of the contacts, whatever the direction of the current.

This force plays the same role as the force of attraction due to the magnetic pieces 6–8 in the embodiment of FIGS. 1 to 5. It is however not as large. To give it a usable value, the air gap between the legs of the U will be advantageously reduced by giving to this central part the shape of a blade placed on edge in a narrow groove or slot of the U.

Figure 11:
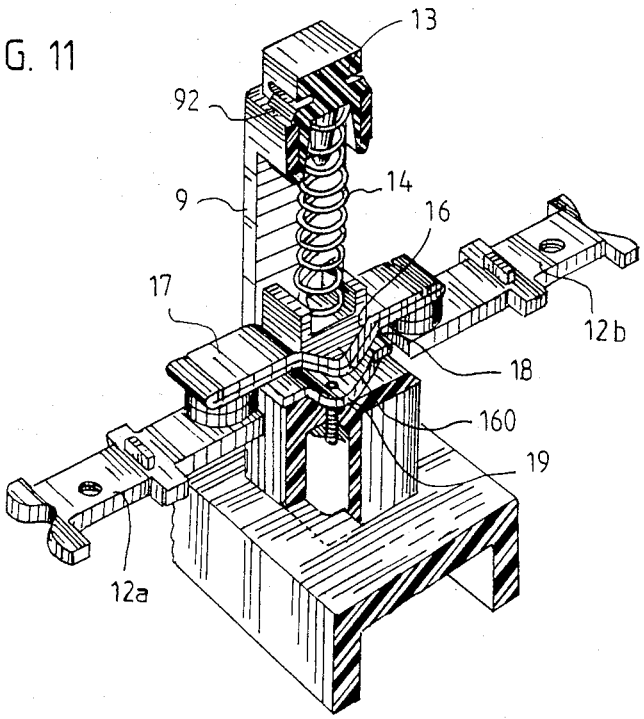
FIG. 11 is a persective view of the contact assembly of a double-break contact-bridge contactor, equipped with a magnetic compensating device in accordance with the third embodiment of the invention.
Figure 12:
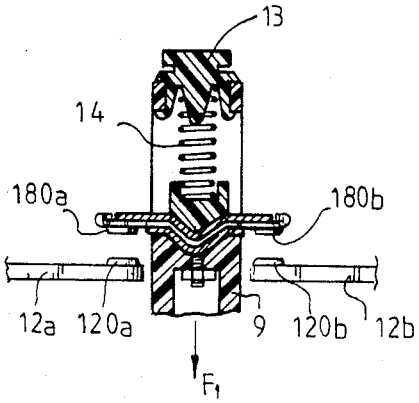
FIGS. 12 and 13 show the same assembly, seen from the front, respectively in the open position and in the closed position.
Figure 13:
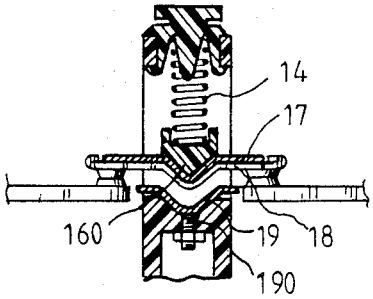

In the embodiment of FIGS. 11 to 13, the fixed contacts **12*a*–120*a*, 12*b*–120*b* are rectilinear as in the embodiment of FIGS. 6 to 10 and the insulating piece 9, integral with the armature of the electromagnet, cooperates at its upper part with an insulating piece 13 identical to that of FIGS. 6 to 10 and also serving for guiding and supporting one end of spring 14. This latter bears, at its other end, on an insulating piece 16 which itself bears, by its central triangular projecting part 160, on a first blade 17 made from a soft magnetic material which, in its turn, bears on a movable contact blade 18, having contacts 180*a*–180*b*. A second blade 19 made from a soft magnetic material is fixed, for example by means of a bolt 190, to the lower part of piece 9**.

When the electromagnet is open (FIG. 12) the three pieces 17–18–19 are in mutual contact, their central parts having shapes such that they fit into one another.

When the electromagnet drives piece 9 in the direction of arrow $F_1$ (FIG. 12), piece 19 is separated from pieces 17–18 and, with piece 13 undergoing the same movement, greater than the distance between the contacts, spring 14 which urged piece 18 on piece 19 until the contacts are established, is then compressed by an additional amount to provide the contact pressure.

When a current flows in the contact blade 18, the magnetic field which it induces in pieces 17–19 results in developing a force of attraction therebetween. This force contributes to holding the contacts and plays then a role similar to that which was described with reference to the preceding figures. By way of example, such a device applied to a contactor of a nominal rating of 12 Amps may withstand effective currents of 5 KA instead of 1.7 KA in the absence of the magnetic holding pieces.

It will be noted that, in the embodiment of FIGS. 6 to 13, which is more particularly suitable to the construction of small or medium power contactors, the conductors supporting the fixed contacts are not bent and do not exert any appreciable electro-dynamic repulsion forces. However, at the level of the contact spot, as was explained above, there appears a striction effect which results finally in repulsion forces which the additional holding force may overcome, up to a certain current threshold.

It goes without saying that the contact shapes shown in the different figures are not limiting. In particular, in the case where the contact bridge is provided to establish a capacitive circuit, which would give rise during closing to transitory periods with frequencies between 500 and 100 Hz for example, with high peak currents, the solutions described would also allow the effect of these transitory periods to be countered.

The device could be applied to single-break assemblies. The shape and arrangement of the magnetic piece or pieces could be varied as well as those of the contact assembly itself.

So that the compensation forces are large, it is advantageous for all the air gaps to remain relatively small in the closed position; in the embodiments of FIGS. 6 to 10, active air gaps are defined by the slit of the U.

In a simplified embodiment of the device described in FIGS. 11 to 13 (where V-shaped fitting together of different parts is obtained), pieces corresponding to those referenced 17, 18, 19 could have flat or rectilinear shapes, means not described but evident for a man skilled in the art, furthermore ensuring lateral holding of the contact bridge and of the ferro-magnetic parts.

A circuit for supplying a load, protecting same and protecting the lines and comprising in series a contactor in accordance with the invention and, either current detection means (for example magneto-thermal) adapted to control the opening of the contactor and an apparatus providing only current limitation (for example a limiting module such as described in French patent application No. 81 15573 filed on the 7th of Aug. 1981 by the applicant for "An automatic device for limiting short-circuit currents", or a fuse), or a circuit-breaker-limiter whose opening also causes opening of the contactor may break, without damage or welding, presumed effective short-circuit currents of the order of 100 KA, providing that the circuit breaker or limiting module limits the peak currents to a value less than 40–50 In.

Such a circuit is then particularly advantageous because it is much easier to produce a circuit-breaker or a limiter stage, which is effectively capable of limiting the above-mentioned peak currents, whereas it is very difficult to limit peak currents of the order of 15 to 20 In for which there appear precisely the faults of traditional contactors.

We claim:

1. A contactor comprising:

a. first and second conductive substantially flat stationary contact carriers symetrically arranged about an axis of symmetry and extending substantially at right angles with said axis of symmetry and first and second stationary contacts mounted on the first and second conductive stationary contact carriers respectively;

b. a movable insulating contact holder mounted for translation along the said axis of symmetry;

c. a U-shaped magnetic member having first and second legs and a groove between said first and second legs, said groove having a bottom, said U-shaped magnetic member being rigidly connected to the contact holder and forming a permanently open magnetic circuit;

d. a magnetic armature resiliently coupled to the contact holder and a permanently open air gap located between the said armature and the said U-shaped magnetic member;

e. a bridging conductive movable contact carrier resiliently coupled to said contact holder and having a central blade which is substantially at right angles with the stationary contact carriers, said blade extending substantially at right angles to the said axis with first and second portions symmetrically arranged with respect to the said axis and first and second movable contacts rigidly coupled to the said first and second portions respectively, the said stationary contact carriers having means for generating electrodynamic blow off forces on the said movable contact carrier, said blade engaging the said groove, whereby the magnetic flux developed in the U-shaped member when overload current flows through the central blade crosses the said groove thereby generating electrodynamic forces forcing the movable contact carrier towards the bottom of the groove and the movable contacts against the stationary contacts; and f. means for exerting on the contact holder a pulling force parallel to the said axis for carrying the said movable contacts into and out of engagement with the stationary contacts.

2. A contactor as claimed in claim 1, wherein said blade has a dimension parallel to said axis which is larger than the depth of the groove, whereby the blade has an outer edge which projects from the groove when the blade abuts the bottom of the groove and the said magnetic armature is mounted for engaging the said outer edge.

3. A contactor as claimed in claim 2, wherein said contact holder has an inner elongate cavity which extends substantially parallel to the said axis and said contactor further comprises:

g. a U-shaped non-magnetic blade member slidably mounted within the said elongate cavity, said blade member having a bottom and first and second legs, said legs having an outer portion which projects from the said cavity and an inner portion, said U-shaped magnetic member being slidably mounted within the outer portion of the U-shaped blade member; and h. spring means lodged between the legs of the said blade within the inner portion thereof and having a first end which bears on the bottom of the blade and a second end which bears on the U-shaped magnetic member.

4. A contactor as claimed in claim 3, wherein said first and second conductive stationary contact carriers are folded and each have first and second substantially parallel legs.

5. A contactor comprising:

a. first and second conductive substantially flat stationary contact carriers symmetrically arranged about an axis of symmetry and extending substantially at right angles with said axis of symmetry and first and second stationary contacts mounted on the first and second conductive stationary contact carriers respectively;

b. a movable insulating contact holder mounted for translation along the said axis of symmetry;

c. a bridging conductive movable contact carrier having a conductive blade which is generally parallel to the stationary contact carriers and which extends substantially at right angles to the said axis with first and second portions symmetrically arranged with respect to the said axis and first and second movable contacts rigidly coupled to the said first and second portions respectively, the said stationary contact carriers having means for generating electrodynamic blow off forces on the said movable contact carrier;

d. a first magnetic blade rigidly connected to the conductive blade and shaped for engagement substantially with the whole surface of the said conductive blade, said first magnetic blade being resiliently coupled to the said contact holder;

e. a second magnetic blade rigidly connected to the contact holder and shaped for engagement with a surface portion of the conductive blade which is substantially smaller than the surface of the said conductive blade, with the conductive blade forming a permanently open air gap between the first and second magnetic blades; and f. means for exerting on the contact holder a pulling force parallel to the said axis for carrying the said movable contacts into and out of engagement with the stationary contacts.

* * * * *